US005228249A

United States Patent [19]

Campbell

[11] Patent Number: 5,228,249

[45] Date of Patent: Jul. 20, 1993

[54] WOODEN FOUNDATION WALL AND METHOD

[76] Inventor: Carl W. Campbell, 17131 Gore St., Detroit, Mich. 48219

[21] Appl. No.: 685,475

[22] Filed: Apr. 12, 1991

[51] Int. Cl.[5] ..... E04B 2/32

[52] U.S. Cl. ..... 52/264; 52/270; 52/274; 52/284; 52/593

[58] Field of Search ..... 52/264, 265, 270, 272, 52/274, 275, 276, 281, 286, 292, 293, 299, 300, 284, 593

[56] References Cited

U.S. PATENT DOCUMENTS

| | | | |
|---|---|---|---|
| 1,236,635 | 8/1917 | Wells | 52/275 |
| 2,129,441 | 9/1938 | Otto | 52/271 |
| 2,255,315 | 9/1941 | Hamilton | 52/264 |
| 3,277,620 | 10/1966 | Martin | 52/292 |
| 3,592,376 | 7/1971 | Moehlenpah . | |
| 3,712,004 | 1/1973 | Loebsack | 52/265 |
| 3,885,368 | 5/1975 | King et al. . | |
| 4,011,701 | 3/1977 | Turkia | 52/275 |
| 4,065,895 | 1/1978 | Shank et al. | 52/274 |
| 4,269,006 | 5/1981 | Larrow . | |
| 4,280,307 | 7/1981 | Griffin | 52/274 |
| 4,378,663 | 4/1983 | Audet . | |
| 4,457,118 | 7/1984 | Bowen . | |
| 4,578,909 | 4/1986 | Henley et al. | 52/275 |
| 4,615,155 | 10/1986 | Chamberlain | 52/270 |
| 4,616,452 | 10/1986 | Lemerre . | |
| 4,669,234 | 6/1987 | Wilnau . | |
| 4,680,418 | 12/1987 | Degut . | |
| 4,862,660 | 9/1989 | Raymond . | |
| 4,894,974 | 1/1990 | Mayhew et al. . | |

FOREIGN PATENT DOCUMENTS

| | | | |
|---|---|---|---|
| 1018013 | 10/1952 | France | 52/274 |
| 2504573 | 10/1982 | France | 52/292 |
| 2622617 | 3/1989 | France | 52/272 |
| 0372149 | 12/1963 | Switzerland | 52/270 |
| 1399421 | 5/1988 | U.S.S.R. | 52/272 |

OTHER PUBLICATIONS

Wood Products Promotion Council, Permanent Wood Foundation Guide to Design and Construction, Rev. Aug., 1988.

*Primary Examiner*—Carl D. Friedman
*Assistant Examiner*—Christopher T. Kent
*Attorney, Agent, or Firm*—Emch, Schaffer, Schaub & Porcello Co.

[57] ABSTRACT

A building foundation wall is assembled from a plurality of rectangular prefabricated wall panel sections constructed of preservative treated lumber. The prefabricated sections are of standardized configurations adapted when disposed in end to end abutment to be substantially self aligning with each other, the standardized configurations including first and second configurations adapted to mate with each other to form a corner of the wall and other configurations adapted to abut each other in a tongue and groove relationship. All panels have an internal frame constructed with spaced vertical studs extending between horizontal top and bottom frame members and inner and outer side panels of plywood nailed to opposite sides of the internal frame. The upper edges of the side panels project above the top frame member of each section to define a lengthwise recess and a coupling board snugly received in the recesses of two abutted panel sections aligns the panel sections and secured them to each other. The panel sections are mounted upon treated wooden footing plates laid in a pattern upon a levelled bed of gravel to constitute the base of the wall.

12 Claims, 4 Drawing Sheets

FIG. 6
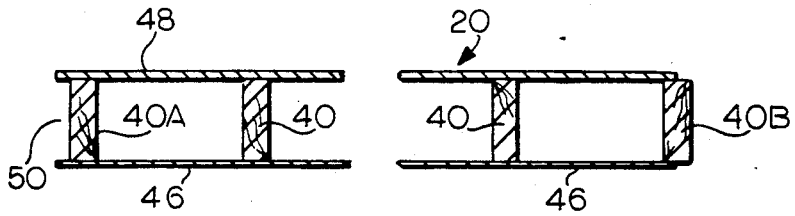
FIG. 7
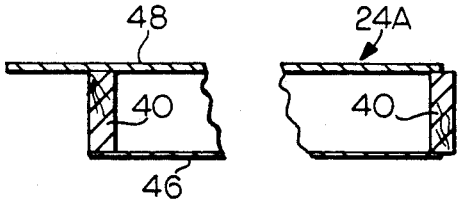
FIG. 8
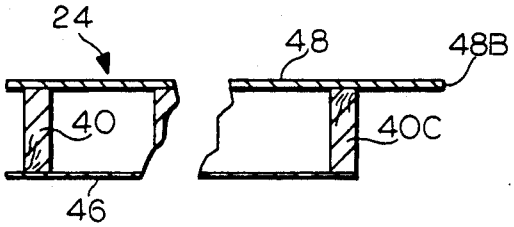
FIG. 9
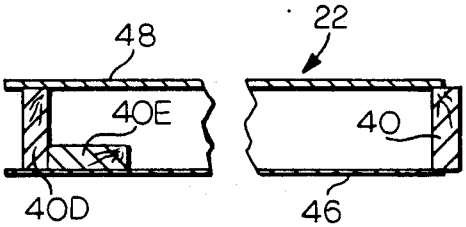
FIG. 10
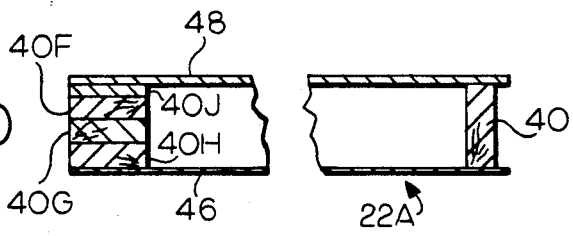
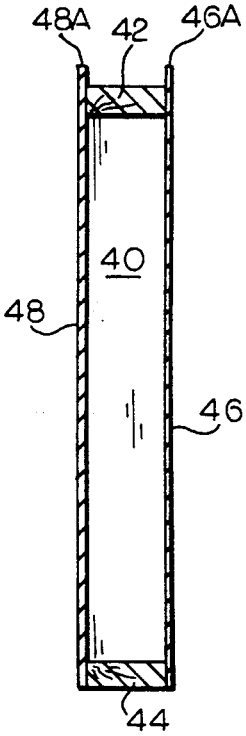
FIG. 5
FIG. 11
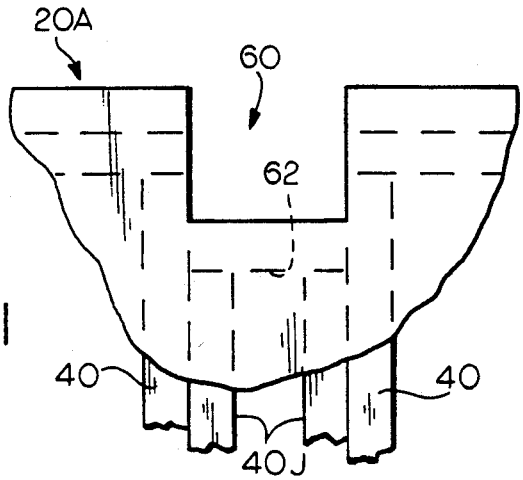

WOODEN FOUNDATION WALL AND METHOD

BACKGROUND OF THE INVENTION

The present invention is directed to a below grade foundation or basement wall which is constructed from prefabricated wooden wall sections made of preservative treated lumber and method for erecting such a wall.

The construction of a foundation wall which will be at least partially below the finished grade from prefabricated wooden wall sections provides several major advantages over the more conventional poured concrete wall. Erection of a foundation wall from prefabricated wooden sections is a task somewhat comparable to that of erecting the forms for a poured concrete wall. When the wooden wall is erected, it is ready to use, erection of the forms for a concrete wall is merely the first step in a process which subsequently requires the pouring of concrete, the curing of the poured concrete and finally the removal of the forms from the cured concrete wall.

The present invention is directed to prefabricated wall section structures which are readily assembled from standard sized studs, planks and plywood sheets which have been treated with a suitable preservative and a method by means of which standardized corner and intermediate panels are readily joined in aligned end to end relationship with each other at the building site to define a continuous foundation wall.

SUMMARY OF THE INVENTION

In accordance with the present invention, prefabricated wall sections are constructed in a limited number of basic wall section forms of standardized height and length. All wall sections include a rectangular internal frame made up of vertical studs assembled in a conventional manner between horizontal top and bottom frame members, the studs and frame members all being of the same width and thickness—i.e. 2×6 or 2×8, etc. Rectangular sheets of treated plywood are fixedly secured to the opposite sides of the internal frame to enclose the spaces between the studs and top and bottom frame members, these spaces then being filled with a thermal insulating material.

The lower edges of the plywood sheets are located flush with the lower surface of the bottom frame member of the panel section so that the panel section may rest upon and be toe nailed into a treated wood footing plate, typically a length of 2×12 stock which is laid upon and staked in position on a leveled bed of aggregate such as gravel, crushed rock, etc. The top edges of the plywood panels project upwardly above the top surface of the top frame member of the panel section to form a recess extending the length of the top of the section which can receive a plank or coupling board of the same width as the top frame member which will overlap the joint between two adjacent panels to secure the panels to each other in longitudinally aligned end to end relationship.

Two types of wall panel section are employed at each corner of the foundation. One of these types of corner sections is formed with a vertical end edge defined by the vertical end edges of the two plywood panels and the exposed vertical surface of the endmost stud which is flush with the panel end edges. The second type of corner section is formed with one of the two plywood panels projecting beyond the stud at the end edge of the panel section by a distance equal to the panel section thickness so that a corner panel section of the first described type may have its vertical end face seated in face to face engagement with one side of the projecting portion panel of the second corner section and one side surface of the first described corner section disposed in face to face engagement with the endmost stud of the second corner section. Where an exterior corner is involved, simple nailing of the two corner sections to each other in the relationship just described is sufficient. Where an interior corner is involved, one of the second described corner units may be employed with a modified section with aligned panels disposed in abutment with the projecting panel of the second corner section. Studding and bolts are used to join the abutting portions together. An L-shaped section is then placed over the internal corner joint. Joints of panels along the length of the wall preferably are of a tongue and groove configuration achieved by offsetting the vertical stud at one end of a panel outwardly from the adjacent vertical edges of the plywood sheets and offsetting the stud at the opposite end of the panel an equal amount inwardly from the vertical end edges of the plywood sheets. The two studs are then joined together by suitable fasteners.

Other objects and features of the invention will become apparent by reference to the following specification and to the drawings.

BRIEF DESCRIPTION OF THE DRAWINGS

FIG. 5 is a detail cross sectional view of the panel of FIG. 4 taken on the line 5—5 of FIG. 4;

FIG. 6 is a detail cross sectional view taken on the line 6—6 of FIG. 4;

FIG. 7 is a detail cross sectional view similar to FIG. 6 but showing a different type or configuration of wall sections;

FIG. 8 is a detail cross sectional view similar to FIG. 6 but showing another different wall section configuration;

FIG. 9 is a detail cross sectional view similar to FIG. 6 but showing another different wall section configuration;

FIG. 10 is a detail cross sectional view similar to FIG. 6 but showing another different wall section configuration;

FIG. 11 is a partial side elevation, with certain parts broken away, showing a beam saddle formed in a wall panel section.

DESCRIPTION OF THE PREFERRED EMBODIMENTS

Figure 1:
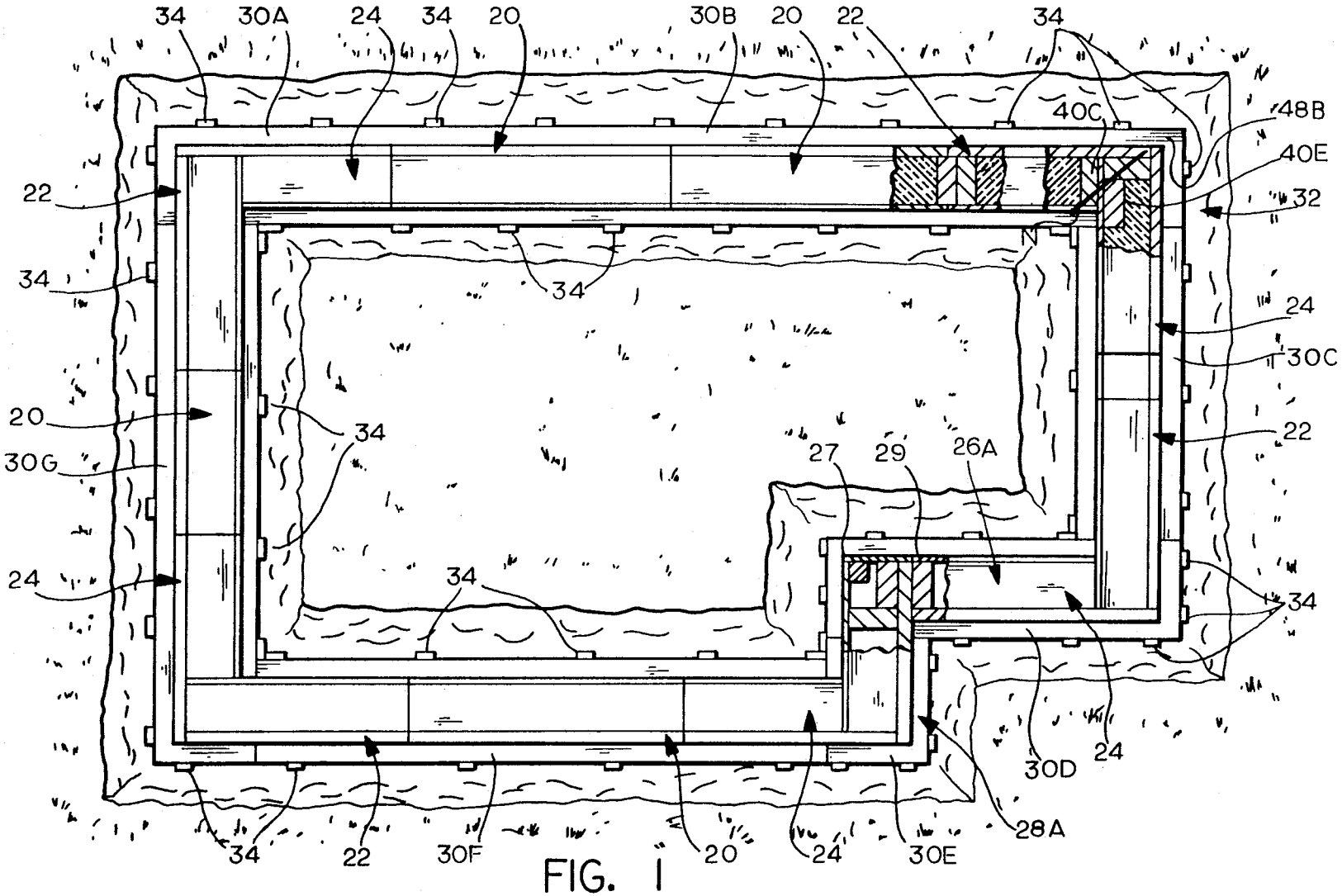
FIG. 1 is a top plan view, not to scale and with the relative proportion of various parts exaggerated for purposes of explanation, with certain parts of the structure broken away.

Referring first to FIG. 1, there is shown a top plan view, with certain parts broken away, of an exemplary foundation wall embodying the present invention. While a typical foundation wall will be of rectangular configuration, the wall of FIG. 1 is shown with one internal corner for purposes of explanation. The proportions of the various structural elements shown in FIG. 1 relative to one another has been greatly exaggerated, again for purposes of explanation.

In the foundation wall of FIG. 1, individual standardized prefabrication wall section units of three different configurations are shown and designated generally 20, 22 and 24, while prefabricated units of foreshortened length are employed to form the internal corner of the wall illustrated and designated generally 26A, 28A. The individual wall sections are supported upon a footing plate assembly made up of lengths of a preservative treated timber or heavy plank, such as a two by twelve timber, the footing plates being indicated at 30A, 30B, etc. The footing plates 30A–30G are supported upon a leveled bed of gravel, crushed rock or similar material at the bottom of the foundation excavation and are held in position on the bed 32 as by wooden stakes 34.

Figure 4:
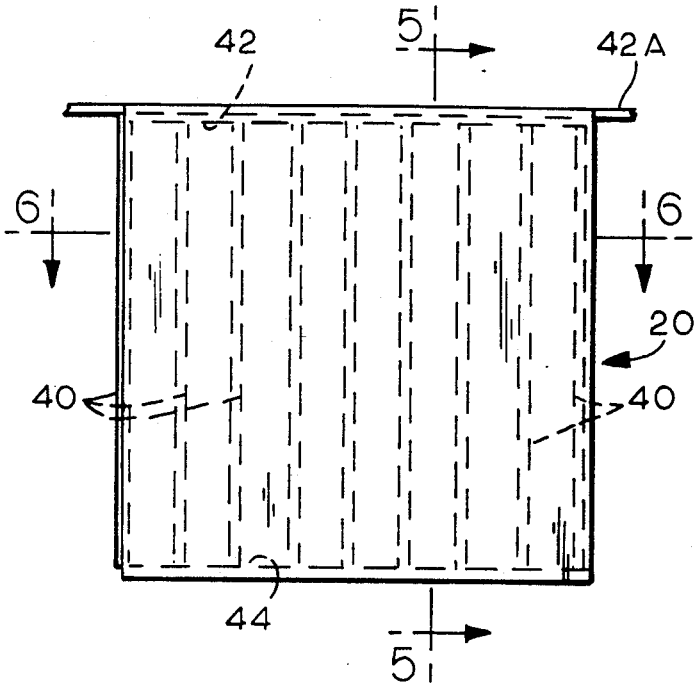
FIG. 4 is a side elevation of one type of wall panel section according to the present invention.
Figure 2:
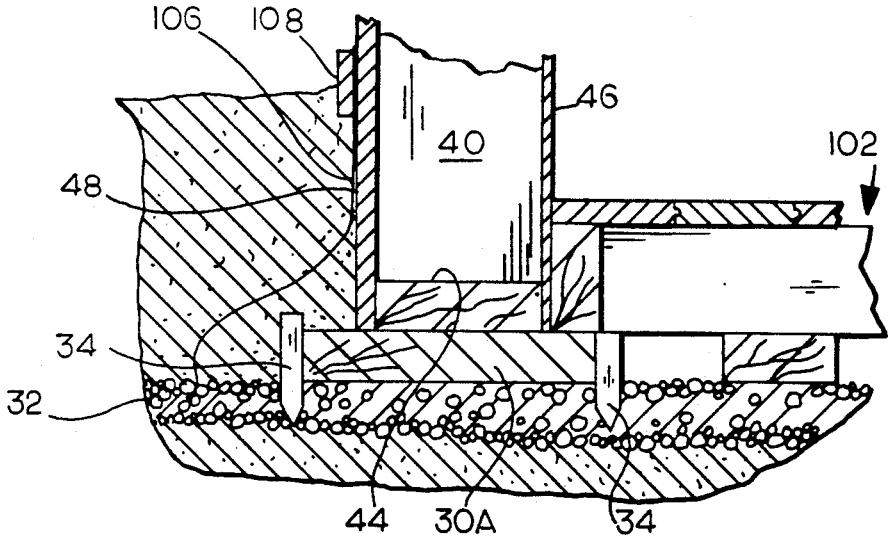
FIG. 2 is a detail cross sectional view of a foundation wall taken through the lower portion of a wall section.
Figure 3:
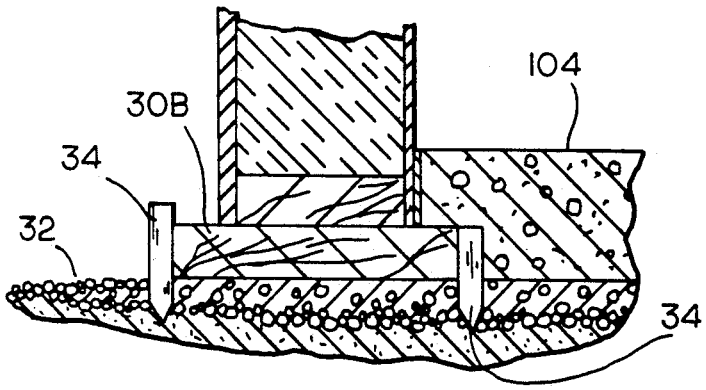
FIG. 3 is a cross sectional view similar to FIG. 2 showing a modified form of flooring employed in conjunction with the wall section.

Various standardized panel configurations are described in detail below. All have the common feature of being constructed with an internal frame, typically of 2×6 or 2×8 stock with spaced vertical studs 40, see FIG. 4, extending between horizontally extending top 42 and bottom 44 frame members. The studs 40 are spaced at a maximum of two feet apart. Inner and outer plywood panels 46, 48, see FIG. 2, are nailed to the opposite sides of the internal frame. The internal frame members and the plywood panels are treated with an appropriate commercially available preservative, one example of such treated lumber being widely available under the mark WOLMONIZED. Stainless steel nails are employed through the assembly of the panels. Typically, outer panels 48 are relatively thick—i.e. five to seven ply panels of a minimum half inch thickness. Inner panels 46 may be thinner—one quarter to one half inch plywood. After the panel has been assembled, one or more apertures are drilled in the top frame member and a suitable commercially available thermal insulation material, such as a cellulose material, is blown in under pressure, i.e., 3 to 4 pounds of pressure, to completely fill the spaces between the panels and studs. It will be understood that any other type of insulation with and without pressure and which will not settle during use can also be employed in the panels.

All of the various panel configurations to be described below also have a common transverse cross sectional configuration similar to that shown in FIG. 5 in which the lower edges of the inner and outer panels 46, 48 are flush with the bottom surface of lower frame member 44, while the upper edges 46A, 48A of the two panels project upwardly above the top surface of top frame member 42 by a distance equal to the thickness of frame member 42. This upward projection of the two plywood panels provides a recess extending the length of the top of each panel which can receive a length of stock which extends across the seam between two panels to interlock and align the two panels with each other.

In FIGS. 6–10, cross sectional views illustrating various standard panel configurations are presented. The panel configurations are so designed that standardized prefabricated panels extend around the periphery of the foundation wall in head to tail relationship. The vertical joints between adjacent panels are, except at wall corners, formed to interfit with each other in a tongue and groove relationship.

In FIG. 6, it is seen that at one vertical end edge of panel section 20, the stud 40A at that end is offset inwardly from the vertical end edges of the panels 46, 48 to form a groove 50 having a depth equal to one half of the thickness of the stud 40A. At the opposite vertical end edge of the panel section, the endmost stud 40B is offset outwardly from the adjacent end edges of panels 46 and 48 by a distance equal to one half of its thickness. It is believed apparent that the "tongue" defined by the stud 40B of one panel will fit into the groove 50 of another like panel 20. When two panels 20 are so fitted together a coupling plate formed of a length of stock of the same cross sectional dimensions as the studs and frame members of the panel is seated in the recess formed at the top of the two panels between the upwardly projecting top edges 46A, 48A (FIG. 5) to extend across the joint between the two panels 20 to be nailed in place to align and join the two panels to each other. The panels 20 may be referred to as "filler" panels which define the intermediate portions of the wall sections.

In FIGS. 7–10 panel configurations employed at outside corners of the foundation wall are disclosed. A cross sectional view of the opposite vertical end edges of the panel section 24 of FIG. 1 are shown in FIG. 8. In this particular type of corner section, the outer panel 48 of the unit is extended beyond the stud 40C at the right-hand end of the panel as viewed in FIG. 8. The extended portion 48B projects beyond the endmost stud 40C by a distance equal to the thickness of an assembled panel.

In FIG. 1, a corner panel 24 is shown at the upper right-hand corner of that Figure mated with a mating corner panel 22, shown in FIG. 9. Panel 22 is constructed with the stud 40D at one end of the panel flush with the vertical end edges of the inner and outer panels 46, 48. A second stud 40E is located as shown in FIG. 9 at the inner side of stud 40D in engagement with the inner panel 46 of the corner unit 22. The extra stud 40E provides an increased stiffness to the assembled corner and enables the mating corner elements 22, 24 to be firmly toe nailed to each other from the inner side of the wall as by nails N (FIG. 1).

The corner unit 24A shown in FIG. 7 is, in effect, a left-handed version of the corner unit 24 of FIG. 8. The corner unit 22A of FIG. 10 is a modified version of the corner unit 22 of FIG. 9 with a plurality of 2-inch studs 40F, 40G, 40H and a ¾ inch stud 40J disposed in face to face engagement with each other as indicated in FIG. 10. The studs 40F, 40G could equally well extend in an orientation perpendicular to that of FIG. 10— i.e. in the same direction as the stud 40D in FIG. 9. It is believed apparent that whether the stud at the opposite (right-hand end) of the panels 22, 22A projects beyond the inner and outer side panels as in FIG. 9 or is recessed as in FIG. 10 is a matter of choice.

In FIG. 11, a so-called "center panel" 20A for supporting a joist carrying beam is disclosed. Only a portion of the top edge of the panel 20A is shown in FIG. 11, the remainder of the panel 20A may be assumed to be identical with the panel 20 shown in FIG. 4. The panel section 20A is formed with a beam receiving saddle 60 in its upper edge by cutting a recess configured as shown in FIG. 11 downwardly into the upper edge of the panel section. A horizontal beam support member 62 is located to extend horizontally between two adjacent studs 40 of the panel and is braced from below as by two or more support studs 40J as indicated in FIG. 11. Center panel sections 20A will be located at opposite side walls of the foundation wall and a beam, which may take the form either of a single timber or parallel planks on edge has its opposite ends seated in the beam receiving saddles 60 of the two center sections.

FIG. 1 also shows an inside corner made up of a modified corner section 28A and a short insert section 29. The insert section 29 has the panels of equal length and disposed in abutting relationship with the adjoining corner section 24. The panel of the inside corner section 28A extends outward and abuts both of the panels in the insert section 29. This panel extends outward from the opposed panel of the inside corner section 28A. A stud is placed across the two panels in the inside corner section 28A as well as on opposite sides of the elongated panel and joined to the appropriate panels by means of suitable fasteners. A corner cover section 27 of a generally L-shape is placed over the corner joint of the inside corner section 28A and the insert section 29 to cover the studs and exposed portions thereof. This forms a continuous inside panel section with the adjoining sections 24.

The opposite end of the inside corner section 28A is slightly modified so as to mate with a standard corner section 24.

The panel sections described above may be considered to be basic units which can be prefabricated to standard dimensions, typically eight foot square or eight by twelve panel sections. Where the desired dimension of the dimensions of the foundation wall are other than even multiples of the standard panel lengths, a prefabricated panel may be cut to the desired length in the field. In the event the foundation wall simply encloses a crawl space, the height of the panel sections will be adjusted accordingly.

The corner units shown in FIGS. 7–10 above are intended to be utilized at exterior corners—i.e. the corners of a foundation wall of rectangular configuration. The panels described above are well designed for use as exterior corners in that the pressure of fill dirt against the outer sides of the assembled wall tends to press the abutted ends of the two corner units against each other. At inside corners, however, fill dirt pressure tends to separate the corner units and a somewhat stronger arrangement for coupling two corner units to each other is required for inside corners. Various arrangements for accomplishing this are shown in FIGS. 12–15.

Figure 12:
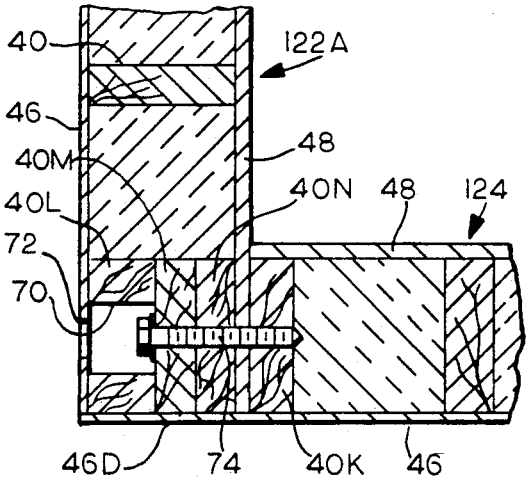
FIGS. 12, 13, 14 and 15 are cross sectional views taken in a horizontal plane showing alternative panel configuration utilized for internal foundation wall corners.
Figure 13:
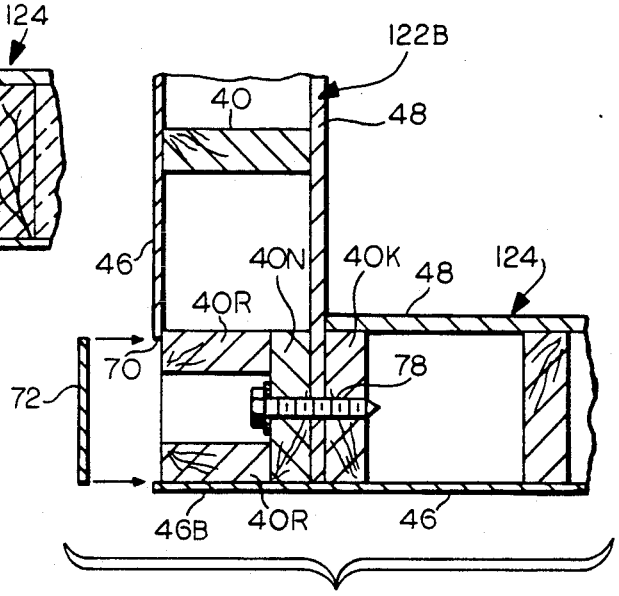
Figure 14:
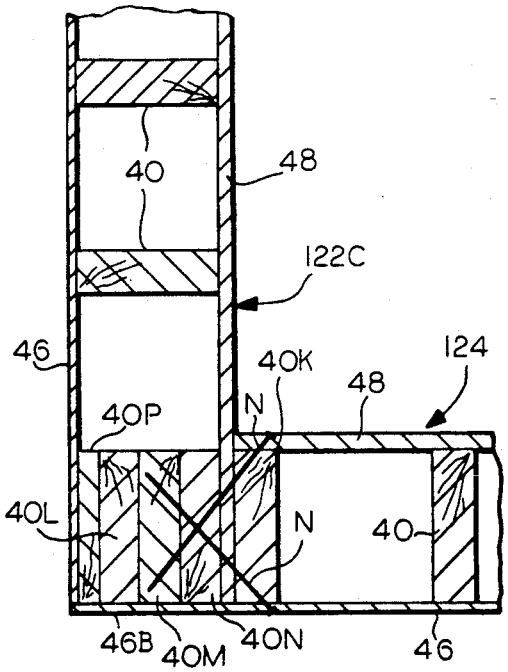
Figure 15:
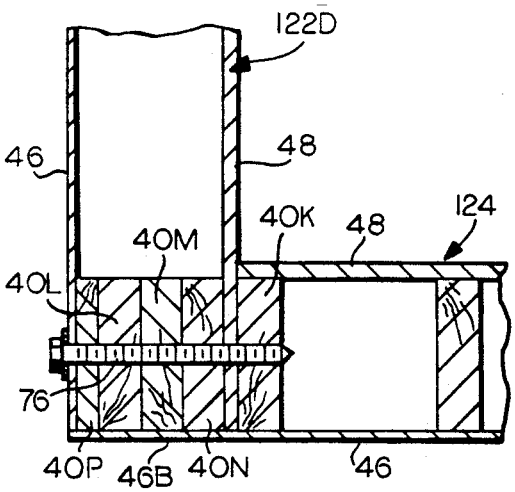

In FIGS. 12–15 all of the various arrangements have a single type of first corner unit 124 and differ from each other by variant forms of the mating corner units 122A of FIG. 12, 122B of FIG. 13, 122C of FIG. 14 and 122D of FIG. 15.

The first corner units 124 find the inner side panel 46 of the unit projected laterally beyond an end stud 40A as at 46B, the section 46B projecting beyond the stud 40A by a distance equal to the thickness of a panel.

Similarly, the corner sections 122A of FIG. 12, 122C of FIG. 14 and 122D of FIG. 15 are substantially similar and include a plurality (three in the forms illustrated) of 2-inch studs 40L, 40M, and 40N and ¾ inch stud 40P (FIGS. 14 and 15) sandwiched between the inner and outer panels 46 and 48 in the fashion shown. In FIG. 12, the stud 40L is formed with a bore 70 aligned with a bore 72 through the inner panel 46. A lag screw 74 whose head is accessible via bores 70, 72 passes through studs 40M, 40N and outer panel 48 of the corner unit 122A and is threadably received in the endmost stud 40K of the mating corner unit 124.

In FIG. 14, the bores 70 and 72 of the FIG. 12 form are not present and the corner unit 122C is secured to its mating corner unit 124 by toenailing as with nails N.

In the embodiment of FIG. 15, a somewhat longer lag screw 76 passes transversely entirely through the end portion of the unit 122D, including 2-inch studs 40L, 40M and 40N and ¾ inch stud 40P to be threaded into the endmost stud 40K of the mating corner unit 124.

In the embodiment of FIG. 13, the relative transverse dimensions of studs 40L and 40N are such that the space between inner and outer panels 40 of the unit 122B is not an even multiple of the stud thickness. In this case, full length studs or filler blocks 40R are emplaced as shown in FIG. 13 between the studs 40N and panel 46. As was the case with the embodiment of FIG. 12, the embodiment of FIG. 13 is formed with bore 70 through inner panel 46 to provide access to the head of a lag screw 78 employed to tie the two mating corner units to each other. Access panel 72 encloses the lag screw 78.

The basic steps in constructing a foundation wall include the normal first step of excavating the foundation hole to the necessary depth below finished grade. The next step is to lay down a bed of loose aggregate material such as gravel, crushed rock, etc. at the bottom of the excavation and leveling this bed at the planned elevation to provide a footing for the foundation wall. The footing plates 30 are then emplaced upon the levelled bed of aggregate to define the base of the wall and staked in position.

The next step is to erect one corner of the completed wall by accurately locating (referring to upper right corner of FIG. 1), mating corner panels such as 22 and 24 upon the footing plates and toenailing the panels 22 and 24 into position upon the footing plates and then toenailing the panels 22 and 24 to each other as by a series of nails N. It is extremely important that the first two corner units 22 and 24 installed as just described be precisely located, plumbed and squared. The two assembled corner units are self supporting, and the next step in the erection of a foundation wall such as shown in FIG. 1 would be to assemble a filler panel 20 in end to end relationship with the installed corner panel 24. This may be accomplished quite easily by abutting the panel 20 in end to end relationship with the corner panel 24 by the tongue and groove arrangement, as shown in FIG. 1. The two panels may be longitudinally aligned with each other at this point by installing the frame coupling plank 42A (see FIG. 4) to extend across the top of the joint between the panel unit 20 and corner unit 24 and nailing this coupling plank to the top frame members 42 of the adjoined units. After checking the alignment of the lower edge of the panel 20, it is then toenailed to the footing plates. Erection of the wall proceeds simply by adding additional panel units in end to end relationship with the previously erected ones until the wall is completed.

It is pointed out that the method just described achieves a foundation wall without requiring the use of any poured concrete. This not only substantially reduces the time and expense of erecting the wall, but is of substantial convenience when the wall is to be installed at a remote location, as for a vacation cabin, for example. As indicated in FIG. 2, a wooden floor designated generally 102 may be installed, if desired, or a concrete floor 104 may be poured after the foundation wall is assembled. In that at least the lower portion of the foundation walls will be below grade, that portion of the wall below the finished grade may be further protected by draping a sheet of heavy plastic material against the outer side of outer panel 48 and holding the plastic sheet 106 in position by a batten 108 nailed to outer panel 48 at a location above the finished grade level, the plastic being so installed before filling.

It should be noted that both plywood panels extend the full length of sections and windows and/or doors may be in any selected section.

While various forms of panels embodying the invention have been disclosed, it will be apparent to those skilled in the art that modifications to the disclosed panels may be made without departing from the spirit of the invention. The foregoing description is to be considered exemplary rather than limiting, and the true scope of the invention is that defined in the following claims.

What is claimed is:

1. A basement foundation comprising:

a plurality of prefabricated rectangular wall sections of uniform height and thickness including (1) a plurality of first corner wall sections, (2) a plurality of second corner wall sections and (3) a plurality of intermediate wall sections joined to form a continuous wall, each of said wall sections including:

horizontally extending top and bottom wooden frame members, a plurality of horizontally spaced vertically extending wooden studs including first and second end studs and intermediate studs, said studs fixedly secured to said horizontally extending top and bottom wooden frame members, said studs and said frame members cooperating to define a rectangular internal frame;

rectangular inner and outer face panels respectively fixedly secured to said internal frame in spaced apart relationship to each other and cooperating with said rectangular internal frame to define a plurality of spaces, each of said face panels having first and second vertical edges and an upper horizontal edge spaced above the top surface of said top frame member to define a recess the width of said top frame member extending the length of said top frame member and a horizontal lower edge flush with the bottom surface of said bottom frame member;

(a) each of said first corner wall sections having said outer face panel longer than said inner face panel such that said first vertical edge of said inner face panel is flush with said first end stud and said first vertical edge of said outer face panel extends beyond said first end stud by a distance substantially equal to the thickness of said wall sections, said second vertical edge of said outer face panel being aligned with the second vertical edge of said inner face panel, said second end stud being positioned between said inner and outer face panels such that it projects beyond said aligned second vertical edges of said inner and outer face panels by approximately one-half its thickness to form a tongue;

(b) each of said second corner wall sections having said inner and outer face panels of equal length, the first vertical edge of said outer face panel being aligned with the first vertical edge of said inner face panel and said first end stud being positioned between said inner and outer face panels such that it is recessed from said aligned first vertical edge of each of said inner and outer face panels to form a groove, the second vertical edge of said outer face panel being aligned with the second vertical edge of said inner face panel and said second end stud being positioned between said inner and outer face panels such that it is aligned with said second vertical edge of said inner and outer face panels;

(c) each of said intermediate wall sections having said inner and outer face panels of equal length, the first vertical edge of said outer face panel being aligned with the first vertical edge of said inner face panel and said first end stud being positioned between said inner and outer face panels such that it projects beyond said aligned first vertical edge of each of said inner and outer face panels by approximately one-half its thickness to form a tongue, and the second vertical edge of said outer face panel being aligned with the second vertical edge of said inner face panel and said second end stud being positioned between said inner and outer face panels such that it is recessed from said aligned second vertical edges of said inner and outer face panels to form a groove;

said first corner wall sections having said first vertical edges of said inner and outer face panels abutting said second vertical edges of said inner and outer face panels of said second corner wall section and said intermediate wall sections being joined to one of the group of (i) said first corner wall section, (ii) said second corner wall section, or (iii) said intermediate wall section.

2. The basement foundation wall according to claim 1 further including a coupling plate positioned in said recess and affixed to said top frame members of adjacent wall sections.

3. The basement foundation wall according to claim 1 further including thermal insulating material positioned between said horizontally spaced vertically extending studs.

4. The basement foundation wall according to claim 1 wherein each of said second corner wall sections has an additional stud affixed to said inner face panel in abutting relationship with said second end stud.

5. The basement foundation wall according to claim 1 wherein said continuous wall has at least four exterior corners and at least one interior corner, said interior corner defined by a third corner wall section joined to a first corner wall section;

(d) said third corner wall section having said inner and outer face panels of equal length, the first vertical edge of said outer face panel being aligned with the first vertical edge of said inner face panel and a plurality of first end studs being positioned between said inner and outer face panels such that at least one of said plurality is in parallel, abutting relationship with said outer face panel and is aligned with said aligned first and second vertical edges and further including at least one lag bolt joining said parallel abutting stud to said first end stud of said first corner wall section.

6. A basement foundation according to claim 1 further including (i) footing plates supporting each of said (a) first corner wall sections, (b) second corner wall sections and (c) intermediate wall sections and (ii) a wooden floor supported at least partially on said footing plates and secured to adjacent ones of said wall sections.

7. A basement foundation wall comprising:

a plurality of prefabricated rectangular wall sections of uniform height and thickness including (1) a plurality of first corner wall sections, (2) a plurality of second corner wall sections and (3) a plurality of intermediate wall sections joined to form a continuous wall, each of said wall sections, including:

horizontally extending top and bottom wooden frame members, a plurality of horizontally spaced vertically extending wooden studs including first and second end studs and intermediate studs, said studs fixedly secured to said horizontally extending top and bottom wooden frame members, said studs and said frame members cooperating to define a rectangular internal frame;

rectangular inner and outer face panels respectively fixedly secured to said internal frame in spaced apart relationship to each other and cooperating with said rectangular internal frame to define a plurality of spaces, each of said face panels having first and second vertical edges and an upper horizontal edge spaced above the top surface of said top frame member to define a recess the width of said top frame member extending the length of said top frame member and a horizontal lower edge flush with the bottom surface of said bottom frame member;

(a) each of said first corner wall sections having said outer face panel longer than said inner face panel such that said first vertical edge of said inner face panel is flush with said first end stud and said first vertical edge of said outer face panel extends beyond said first end stud by a distance substantially equal to the thickness of said wall sections, said second vertical edge of said outer face panel being aligned with the second vertical edge of said inner face panel, said second end stud being positioned between said inner and outer face panels such that it is recessed from said aligned second vertical edges of said inner and outer face panels to form a groove;

(b) each of said second corner wall sections having said inner and outer face panels of equal length, the first vertical edge of said outer face panel being aligned with the first vertical edge of said inner face panel and said first end stud being positioned between said inner and outer face panels such that it projects beyond said aligned first vertical edge of each of said inner and outer face panels to form a tongue, the second vertical edge of said outer face panel being aligned with the second vertical edge of said inner face panel and said second end stud being positioned between said inner and outer face panels such that is aligned with said second vertical edge of said inner and outer face panels;

(c) each of said intermediate wall sections having said inner and outer face panels of equal length, the first vertical edge of said outer face panel being aligned with the first vertical edge of said inner face panel and said first end stud being positioned between said inner and outer face panels such that it projects beyond said aligned first vertical edge of each of said inner and outer face panels by approximately one-half its thickness to form a tongue, and the second vertical edge of said outer face panel being aligned with the second vertical edge of said inner face panel and said second end stud being positioned between said inner and outer face panels such that it is recessed from said aligned second vertical edges of said inner and outer face panels to form a groove;

said first corner wall sections having said first vertical edges of said inner and outer face panels abutting said second vertical edges of said inner and outer face panels abutting said second corner wall section and said intermediate wall sections being joined to one of the group of (i) said first corner wall section, (ii) said second corner wall section, or (iii) said intermediate wall section.

8. The basement foundation wall according to claim 7 further including a coupling plate positioned in said recess and affixed to said top frame members of adjacent wall sections.

9. The basement foundation wall according to claim 7 further including thermal insulating material positioned between said horizontally spaced vertically extending studs.

10. The basement foundation wall according to claim 7 wherein each of said second corner wall sections has an additional stud affixed to said inner face panel in abutting relationship with said second end stud.

11. The basement foundation wall according to claim 7 wherein said continuous wall has at least four exterior corners and at least one interior corner, said interior corner defined by a third corner wall section joined to a first corner wall section;

(d) said third corner wall section having said inner and outer face panels of equal length, the first vertical edge of said outer face panel being aligned with the first vertical edge of said inner face panel and a plurality of first end studs being positioned between said inner and outer face panels such that at least one of said plurality is in parallel, abutting relationship with said outer face panel and is aligned with said aligned first and second vertical edges and further including at least one lag bolt joining said parallel abutting stud to said first end stud of said first corner wall section.

12. A basement foundation according to claim 7 further including (i) footing plates supporting each of said (a) first corner wall sections, (b) second corner wall sections and (c) intermediate wall sections and (ii) a wooden floor supported at least partially on said footing plates and secured to adjacent ones of said wall sections.

* * * * *